United States Patent [19]

Hopmann et al.

[11] Patent Number: 4,739,134

[45] Date of Patent: Apr. 19, 1988

[54] VALVE MONITORING SWITCH ASSEMBLY

[75] Inventors: Robert E. Hopmann, St. Louis; David L. Royse, Ellisville, both of Mo.

[73] Assignee: Potter Electric Signal Co., St. Louis, Mo.

[21] Appl. No.: 51,706

[22] Filed: May 20, 1987

[51] Int. Cl.[4] ..... H01H 9/06

[52] U.S. Cl. ..... 200/61.86

[58] Field of Search ..... 200/61.86, 81.9 R, 81.9 HG, 200/81.9 M, 83 R, 83 J, 83 Q, 293-296; 137/551, 552, 554, 556

[56] References Cited

U.S. PATENT DOCUMENTS 4,110,575 8/1978 Meisenheimer ..... 200/81.9 R
4,695,686 9/1987 Merchant ..... 200/61.86

OTHER PUBLICATIONS

Brochure-"Federal Supervisory Switches PIV/OSY", Federal Signal Corp.; Nov., 1986; 11 pages.
Bulletin No. 719; "PIVSU—A Post Indicator Valve Switch"; Potter Electric Signal Co.; Jul., 1984; 4 pages.
Bulletin No. 20E-16-1; "Supervisory Switches for OS & Y Gate Valves (Series NGV) and Indicator Post Valves (Series NIP)"; Notifier Company; Nov. 1978, 2 pages.
Bulletin No. 20E-16-3, "Supervisory Switch for Post Indicator Valves (PIV)"; Notifier Company; Aug. 1981, 2 pages.

*Primary Examiner*—J. R. Scott
*Attorney, Agent, or Firm*—Jerome A. Gross

[57] ABSTRACT

A valve monitoring switch is operated by an adjustable length rod whose end senses the position of a valve, for example, a water supply valve. The rod, enclosed by an assembly-mounting nipple, is so pivot-mounted as to be capable of movement in a planar arc, whose plane is substantially coincident with or parallel to the component of valve movement as between its open and closed positions. When the rod is pivoted through a small arc of movement, against the bias of conventional electrical switches, they signal the valve position or its change. To effect installation without damage to the switch assembly, an angularly adjustable mounting socket for the nipple is provided; also, the rod length is adjustable, so that during installation it may be retracted alongside the electrical switch assembly; and after installation may be extended to and fixed in a position in which it will sense the state of the valve.

5 Claims, 2 Drawing Sheets

VALVE MONITORING SWITCH ASSEMBLY

FIELD OF THE INVENTION

This invention relates to monitoring switches which sense the position of a control member, for example, a waterflow valve, whose state or change of position may be sensed externally by a component of the movement of some portion of the valve or a mechanical element coupled to it.

DESCRIPTION OF THE RELATED ART

The position of control members, such as valves for the supply of water to sprinkler systems, should be supervised. In the event they are placed in an abnormal position, as to cut off the water supply pending repair, an electrical signal is sent to warn that the normal position should be restored promptly. Such valves may be the familiary butterfly, hand-operated screw, or post indicator type.

Utilizing such water supply valves, electrical switch assemblies have been mounted on or adjacent to them to warn or signal when the valve is so set as not to allow full flow of water. A typical conventional switch assembly heretofore used for this purpose includes a valve position-sensing rod which, on movement of the valve from fully open position, actuates the alarm switch.

The installation of such monitoring switches has heretofore been painstaking; the difficulties varying with the type of valve on which the switch is to be mounted. For example, mounting on a post-type valve involved considerable danger of bending the position-sensing rod as the assembly was turned while screwing into the post; whereas in installing to sense the position of the sector of the worm-drive mechanism of a typical butterfly valve, it has been difficult to pre-cut the position-sensing rod to proper length.

SUMMARY OF THE INVENTION

The general purposes of the present invention are to provide a simple standard monitoring switch capable of easy installation with various types of conventional water supply valves; with exact precision of its placement, and without danger or damage to any part. An added purpose is to permit accurate adjustment of the switch mechanism in valve-sensing position.

These purposes, as well as others which will be manifest from the detailed disclosure, are here achieved by the improvements hereinafter described in detail. They include:

Positioning the electrical switch or switches and the position-sensing rod sidewardly of each other, so that the rod may be retracted safely and compactly during installation and before being extended to final sensing position.

Simplifying construction of the switch assembly, by utilizing the spring bias of the electrical signal switch or switches to operate the pivoted rod assembly. Especially since two such switches are normally provided, one to furnish a remote alarm signal and one for an alarm in the immediate area, their combined spring bias maintains secure contact of the sensing rod against the valve mechanism.

Providing a separate threaded nipple for first screwing into the valve housing, then to be secured within an annular socket on the outer side of a switch mounting plate. This permits installing the switch assembly in proper angular position without turning, avoiding component damage.

These and other improved features of the present invention are discussed and exemplified in the detailed description which follows and in the drawings herewith.

DESCRIPTION OF THE PREFERRED EMBODIMENT

Figure 6:
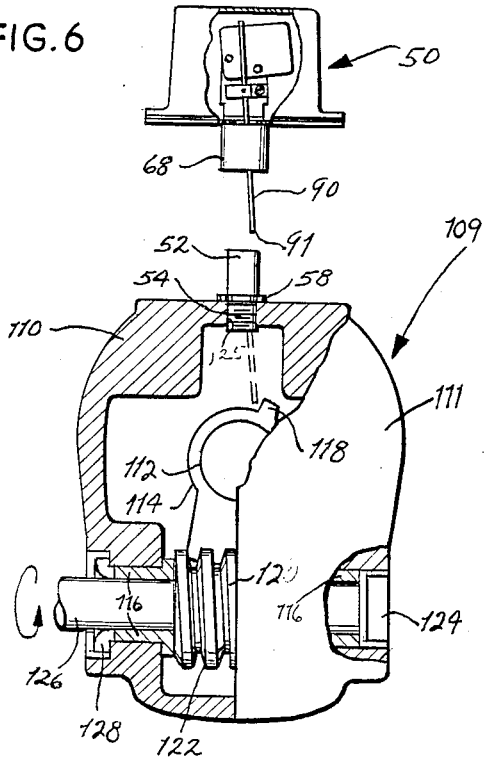
FIG. 6 is a view partly broken away of a worm drive butterfly valve; the valve being only about 80% open and its elements in position for installation of the switch assembly of FIG. 1. The valve itself being conventional, its parts are shown somewhat simplified and schematically.
Figure 7:
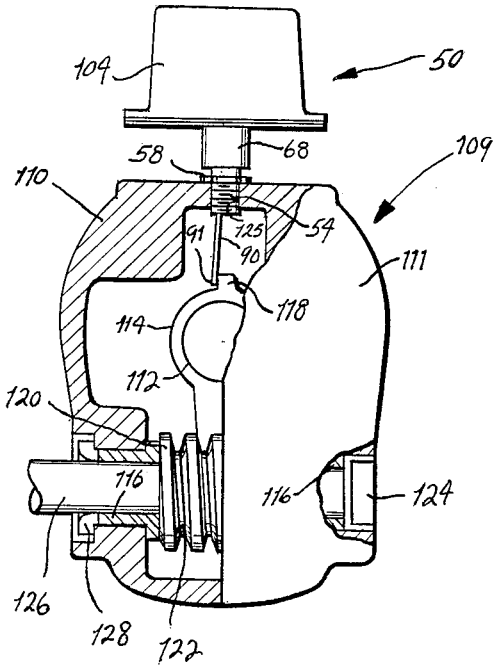
FIG. 7 is a view corresponding to FIG. 6, with the switch of FIG. 1 installed; the valve being fully open.

While the monitoring switch assembly shown in the drawing is capable of a variety of uses to signal the position of control members, it is especially useful with valves which control water supply, such as the worm-driven butterfly valve shown in FIGS. 6–7. Valves of this type have a normally open position which is departed from only in extraordinary circumstances, as in case of a sprinkler supply valve when the system is temporarily shut down for repair. In such case, it is important there be a signal alarm continuing until the control valve is restored to its fully open position.

Figure 2:
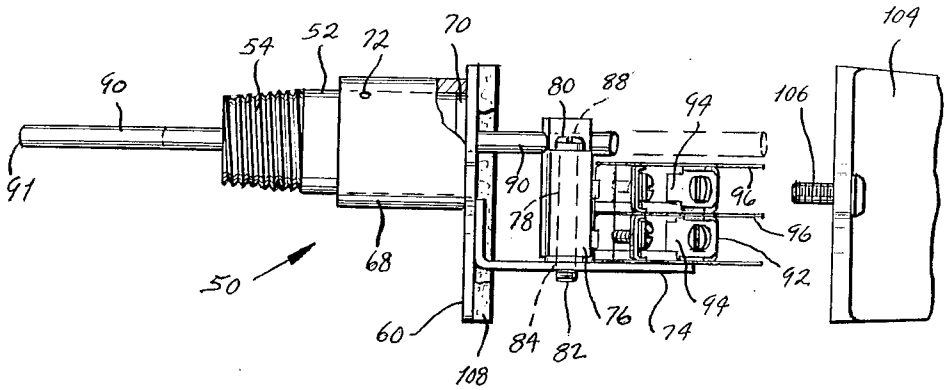
FIG. 2 is a bottom view of the monitoring switch assembly of FIG. 1.
Figure 1:
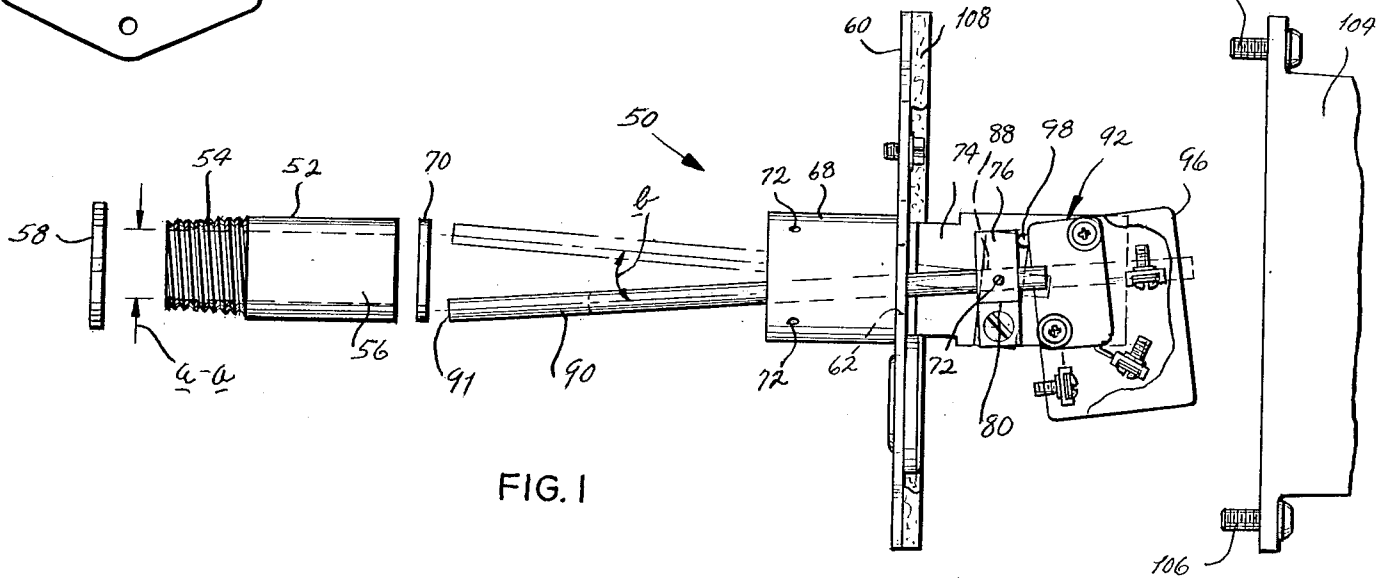
FIG. 1 is a side view of a switch assembly embodying the present invention, with certain parts separated. The phantom lines show range of movement of the parts.

The valve monitoring switch 50 of the present invention, best seen in FIGS. 1–2, has a tubular nipple member 52 whose externally threaded end 54 is screwed into a threaded bore in the wall of the control member housing of a conventional valve. The nipple 52 is then locked in position by tightening a lock nut 58 against the outside wall of such housing. After the nipple 52 is so installed, the remaining components of the switch assembly 50 are simply positioned in their ultimate angular alignment and then secured in place, without need to rotate them and hence without endangering them, as will hereafter be explained.

Figure 3:
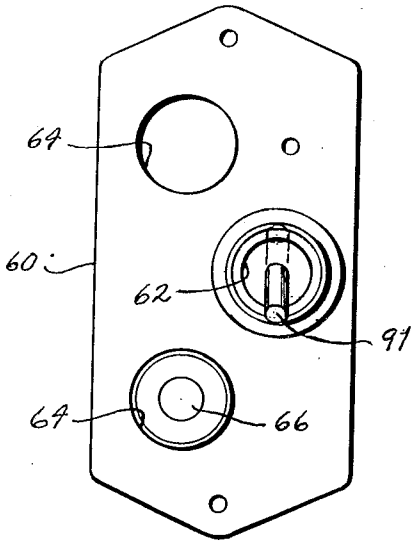
FIG. 3 is a front view of the switch assembly of FIG. 1.

The remaining elements of the monitoring switch assembly 50 shown in FIGS. 1–3 include a mounting plate 60 which is conveniently planar and may have the somewhat hexagonal shape shown in FIG. 3. Three apertures are formed through its surface; a central aperture 62 which accommodates the position-sensing rod 90 hereafter described, and two wiring apertures 64 conveniently located outwardly on either side of the central aperture 62. Since normally only one wiring aperture 64 is utilized, the aperture not being used is weather-sealed with a rubber plug 66.

Extending from the outer side of the mounting plate 60 is an annular socket 68, seen in FIGS. 1–2. The inner diameter of the socket 68 substantially exceeds the diameter of the registering aperture 62. Inserted within the socket's inner diameter, to fit against the surface of the plate 60 and to frame the aperture 62, is a sealing washer 70. To achieve final angular positioning of the switch assembly, the plate 60, bearing the socket 68 with washer 70 installed, is set in its chosen angular position about the unthreaded end 56 of the nipple 52; it is then pressed against the nipple end 56, and two set screws 72 located on the socket wall 68 are tightened, thus mounting the assembly securely.

In the embodiment shown, the side of the mounting plate 60 opposite the annular socket 68 bears a bracket 74 which extends perpendicular to the plane of the plate 60 and is spaced a substantial width away from the aperture 62 so that an electrical switch assembly 92, hereafter described, may be mounted in that width. Mounted onto the bracket 74 is a thick pivot arm 76 having a bore 78 within its edge, which is the lower edge when mounted in the position shown in FIG. 2. Through this bore a pivot pin 80 extends parallel to the plane of the plate 60. The pivot pin's screw end 82 is secured in a tapped bore 84 in the bracket 74. As shown, the level of the pivot pin 80 is offset below the axis of the plate aperture 62.

Extending through the pivot arm 76, perpendicular to and offset above the pivot pin 80 in the FIG. 2 position, is a valve position-sensing rod 90 adjustably secured in a transverse bore 88 by a set screw 72 shown in FIG. 1. This pivot arm bore 88, through which the rod 90 extends to a valve-sensing end 91, is so located that when the pivot arm 76 is at the middle of its range of pivoting, the bore 88 is concentric with the centrally-located aperture 62 in the mounting plate 60. The rod 90 pivots through an arc b which, taken at the threaded end 54 of the nipple 52, is limited by the inner diameter a—a of that nipple end 54.

Figure 4:
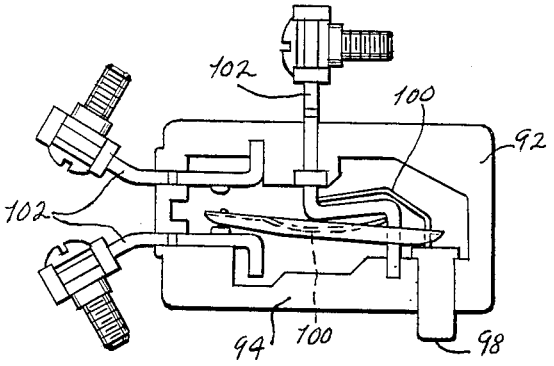
FIG. 4 is an enlarged interior view of a conventional electrical switch, two of which are shown in FIG. 2, with its activating plunger extended.
Figure 5:
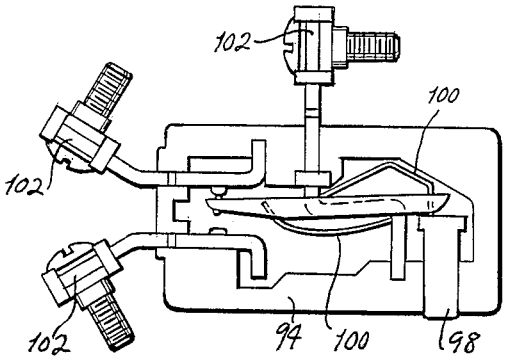
FIG. 5 is a view of the electrical switch of FIG. 5 with its activating plunger pressed inward against spring bias.

Mounted onto the bracket 74 beyond the pivot arm 76 is an electrical switch unit 92, whose sideward extend is less than the offset of the bracket 74 from the plate aperture 62, so as not to interfere with retraction of the position-sensing rod 90. It preferably includes two commonly known electrical switches 94 mounted side by side, separated by thin separator shields 96 as shown in FIG. 2. Operating plungers 98 of these switches 94 project outwardly toward the plate 60 and are biased to bear against the pivot arm 76 at a level offset far upwardly from the pivot pin 80. The switches 94, whose workings are best seen in FIGS. 4–5, typically include a conventional system of biasing springs 100. They exert a following force against the pivot arm so as to cause the pivot arm 76 to turn and maintain the contact of the rod sensing end 91 with the valve control member housing. Such movement of the operating plungers 98 make or break circuit to three connection posts 102, which permit wiring for "normally open" or "normally closed" operation of the alarm system.

A metal housing box 104, shown in FIGS. 1–2, completes the supervisory switch assembly 50. It covers and protects the electrical switch unit 92 and pivot arm 76 and is secured by screws 106 against a gasket 108 along the perimeter of the mounting plate 60.

The features of the present monitoring switch 50 are here illustrated by showing its installation on a worm-driven butterfly valve generally designated 109, being one of the several conventional types of valves used in sprinkler system installations. The monitoring switch assembly 50 is mounted, as shown in FIGS. 6–7, in an access bore 125 of the housing 110 of the worm-driven valve 109, shown with its cover plate 111 broken away. Since such butterfly valves are completely conventional, only its housing 110 and drive elements are shown. Fixed on the end of the butterfly control shaft 112 is a gear sector 114, formed with an abrupt adjacent radial projection or cam 118. This mechanism is shown in FIG. 6 in a position at which the butterfly valve is not fully open, so that water flow is restricted to about 80% of full flow.

A drive shaft 126, on which a worm gear 122 is affixed, extends from an end cap 124 through bushings 116 on either side of the worm gear 122, and thence through a seal 128 at the side of the housing 110 to which the drive shaft 126 projects to a connecting crank (not shown). When the crank is rotated through one turn, as shown in FIG. 7, the worm gear convolutions cause the gear sector 114 to move arcuately between the FIG. 6 and FIG. 7 positions, causing a corresponding movement of the switch-operating projection or cam 118.

The steps for mounting the monitoring switch assembly on the butterfly valve of FIGS. 6 and 7 are as follows:

The threaded end 54 of the tubular nipple 52 is screwed into the threaded bore 125 of the valve housing 110. The nipple 52 is locked into position by tightening the lock nut 58 against the outside wall of the housing 110. The operative elements of the switch assembly 50 which are mounted on the mounting plate 60 as shown in FIG. 1, are then positioned onto the nipple 52. At this time the butterfly valve is in the partly closed position of FIG. 6, so that the switch-operating projection or cam 118 is somewhat removed arcuately, as there shown; and the position-sensing rod 90 is in the retracted position shown in phantom lines in FIG. 1. Then, positioning the mounting plate 60 so that the sensing rod 90 will move in the plane of movement of the sector 114, the socket 68 is secured in angular position relative to the nipple 52, by tightening the set screws 72.

The position-sensing rod 90 is then extended as shown in phantom lines in FIG. 6, so that its sensing end 91 contacts the gear sector 114, and then is retracted approximately 1/32 inch to provide clearance. The set arrow 72 on the pivot arm 76 is tightened to secure the rod 90 in this extended position. Once the rod 90 is in place, the drive shaft 126 is rotated so as to move the gear sector's switch-operating projection or cam 118 into the fully open valve position shown in FIG. 7. The projection or cam 118 thus drives the valve sensing rod 90 to the FIG. 7 position. This serves to activate the electrical switches 94 as the sensing rod 90 moves, as seen in FIG. 1, from its solid line position to its phantom line position.

Installation of the monitoring switch assembly 50 in this manner protects the position-sensing rod 90 from damage in two ways. First, by initially securing the nipple 52 separately to the housing 110, the installer does not, as in the prior art, rotate the sensing rod 90; its sensing end 91 is thus protected from bending or distortion caused by its striking parts within the housing 110. This is of importance should the installer have failed to close the valve of the FIG. 6 partly closed position. Second, the small clearance, readily established in the FIG. 6 position by first advancing the rod 90 to make contact and then withdrawing it slightly and securing it by the set screw 72, is arrived at in a positive manner. In contrast, if the length of the sensing rod 90 was not so adjustable and had to be cut off, as in the prior art, it would be most difficult to measure its proper length through the housing bore 125; and mismeasurement might render the entire assembly useless.

Reference is made in the claims to a plane, shown in the drawings, as the plane of the plate 60 and its aperture 62. Obviously the shape of the plate may be modified, as by bulging out of planar; use of the term is convenient in describing the general arrangement and alignment of the operating components; and the term is not to be taken as limiting. Also for clarity, the terms "sideward" and "vertical" are used in reference to the switch installations here illustrated and described; in the claims they are to be interpreted broadly as directions removed 90 degrees from each other. Similarly, the term "level" is not to be restricted to the vertical sense, here meaning instead the relative offset of the parts. The term "component of movement" includes those elements which may be mechanically coupled to the valve to indicate movement from an ordinarily open position, such as the projection or cam 118 of the embodiment illustrated in the drawings.

The present monitoring switch, shown in FIGS. 6 and 7 with a conventional worm gear driven butterfly valve, may also be utilized with conventional post indicator valves, hand-operated screw valves and other familiar types of water supply valves, and from the foregoing description the manner of installation thereon will be obvious to those skilled in the art. The monitoring switch assembly further has useful application to monitor other control members whose change from normal position ought to be signalled, as for example, a main electrical switch. Accordingly the term "valve" as used in the claims is not limited to valves for liquids, but includes mechanisms, such as electrical switches, which control other flows.

As various modifications may be made in the constructions herein described and illustrated without departing from the scope of the invention, it is intended that all matter contained in the foregoing description or shown in the accompanying drawings shall be interpreted as illustrative rather than limiting.

What is claimed is:

1. For use with a valve whose change of position within a housing is to be sensed by a component of movement within such housing of such valve or of a mechanical element coupled thereto, a valve monitoring switch assembly comprising a tubular nipple member, and a switch-mounting plate assembly including a mounting plate having an aperture therethrough, an electrical switch unit mounted to and extending from the inner side of said plate, said switch unit further having mounted thereto a position-sensing switch operator rod pivot-mounted relative to said switch unit and extending through said plate aperture and terminating in a rod end substantially beyond the outer side of said plate whereby on pivot movement of said rod its said end will describe an arc, said mounting plate having on its outer side an annular surface about said plate aperture, wherein said tubular nipple member is separate from said mounting plate assembly and has an annular surface complementary to said annular surface of the mounting means on the outer side of the mounting plate, whereby after first screwing said tubular nipple member into such valve housing, the sensing rod of said switch mounting plate assembly is inserted through the nipple member so aligned angularly that the arc of its movement substantially coincides with such component of movement within such housing, and the mounting plate assembly is, without turning, then secured to the nipple member in final angular position.

2. For use with a valve whose change of position within a housing may be sensed by a component of movement within such housing of such valve or of a mechanical element coupled thereto, a valve monitoring switch assembly including, mounting means, a switch-mounting plate assembly supported by said mounting means and including a mounting plate having an aperture therethrough, an electrical switch unit mounted to and extending from the inner side of said plate, said switch unit further having mounted thereto a position-sensing switch-operator rod pivot-mounted relative to said switch unit and extending through said plate aperture and terminating in a rod end substantially beyond the outer side of said plate, whereby on pivot movement of said rod its said end will describe an arc, the pivot mount of said rod having means to permit linearly adjustable advancement and retraction of said rod through said plate aperture and its securement, relative to said switch unit in such advanced position, whereby after mounting said monitoring switch assembly, with the rod retracted, onto such valve housing, the sensing rod is so advanced and secured that its rod end senses such valve component of movement.

3. A valve monitoring switch assembly as defined in claim 2 wherein said electrical switch unit is mounted offset from the plate aperture, and wherein a portion of said sensing rod, when retracted in its said pivot mount relative to said switch unit, extends alongside said offset-mounted switch unit.

4. A valve monitoring switch assembly as defined in claim 2, wherein said pivot mount of the position-sensing rod includes a pivot axis and a pivot arm extending therefrom in which said rod is mounted spacedly away from said axis, and wherein the electrical switch unit has switch actuator means to exert spring bias against said pivot arm spacedly from said pivot axis, whereby said spring bias-exerting means provides a following force by which said arc-describing rod end maintains contact with and follows the position of such valve component of movement.

5. For use with a valve whose change of position within a housing is to be sensed by a component of movement within such housing of such valve or of a mechanical element coupled thereto, a valve monitoring switch assembly comprising a switch-mounting plate assembly including a mounting plate having an aperture therethrough, an electrical switch unit mounted to and extending from the inner side of said plate, said switch unit further having mounted thereto a position-sensing switch operator rod pivot-mounted relative to said switch unit and extending through said plate aperture and terminating in a rod end substantially beyond the outer side of said plate, whereby on pivot movement of said rod its said end will describe an arc, said mounting plate having on its outer side an annular surface about said plate aperture, in combination with a tubular nipple member separate from said mounting plate assembly having one threaded end and having on its end opposite said threaded end, an annular surface complementary to said annular surface of said mounting means on the outer side of the mounting plate, and wherein the pivot mount of said rod having means to permit linearly adjustable advancement and retraction of said rod through said plate aperture and its securement relative to said switch unit when so advanced, whereby after first screwing the threaded end of said tubular nipple member into such valve housing, the mounting plate assembly is then secured to the said opposite end of the nipple member in final angular position and the sensing rod is advanced to and is secured in position for sensing such component of movement.

* * * * *

UNITED STATES PATENT AND TRADEMARK OFFICE

CERTIFICATE OF CORRECTION

PATENT NO. : 4,739,134

DATED : April 19, 1988

INVENTOR(S) : Robert E. Hopmann, et al.

It is certified that error appears in the above-identified patent and that said Letters Patent is hereby corrected as shown below:

Column 1, line 19, delete "familiary" and substitute ---familiar---.

Column 3, line 40, delete "tend" and substitute ---tent---.

Column 4, line 46, delete "arrow" and substitute ---screw---.

Column 4, line 64, delete "of" and substitute ---to---.

Signed and Sealed this

Sixth Day of September, 1988

*Attest:*

DONALD J. QUIGG

*Attesting Officer*

*Commissioner of Patents and Trademarks*